US009833075B2

(12) United States Patent
Unwalla

(10) Patent No.: US 9,833,075 B2
(45) Date of Patent: Dec. 5, 2017

(54) CHAIR WITH ADJUSTABLE BACKREST AND SEAT

(71) Applicant: GODREJ & BOYCE MFG CO LTD, Mumbai, Maharashtra (IN)

(72) Inventor: Jamshed Unwalla, Oakville (CA)

(73) Assignee: GODREJ & BOYCE MFG CO LTD, Mumbai, Maharashtra (IN)

( * ) Notice: Subject to any disclaimer, the term of this patent is extended or adjusted under 35 U.S.C. 154(b) by 222 days.

(21) Appl. No.: 14/426,087

(22) PCT Filed: Aug. 27, 2013

(86) PCT No.: PCT/CA2013/000744
§ 371 (c)(1),
(2) Date: Mar. 4, 2015

(87) PCT Pub. No.: WO2014/036633
PCT Pub. Date: Mar. 13, 2014

(65) Prior Publication Data

US 2015/0230608 A1 Aug. 20, 2015

Related U.S. Application Data

(60) Provisional application No. 61/696,965, filed on Sep. 5, 2012.

(51) Int. Cl.
*A47C 1/024* (2006.01)
*A47C 1/032* (2006.01)
*A47C 3/026* (2006.01)

(52) U.S. Cl.
CPC ..... *A47C 1/03255* (2013.01)

(58) Field of Classification Search
CPC ..... A47C 1/03255
(Continued)

(56) References Cited

U.S. PATENT DOCUMENTS 4,411,469 A * 10/1983 Drabert ..... A47C 1/03255 297/300.2
4,451,085 A * 5/1984 Franck ..... A47C 1/03255 297/300.5 X (Continued)

OTHER PUBLICATIONS

Canadian Intellectual Property Office (ISR/CA), "International Search Report", Canada, dated Nov. 28, 2013.

*Primary Examiner* — Rodney B White
(74) *Attorney, Agent, or Firm* — Tim Tingkang Xia, Esq.; Locke Lord LLP

(57) ABSTRACT

An adjustable chair comprises chair support, backrest, a backrest support mechanism including at least one backrest arm pivotally connected to the support, and a seat having front and rear regions and a seat surface. The chair includes first and second seat support mechanisms with the first mechanism adjustably connecting the front region of the seat and the second mechanism adjustably connecting the rear region. The second seat support mechanism includes at least one seat arm having front and rear arm extensions and connected to the support for pivotal movement about a horizontal axis. The rear arm extension is pivotally connected to the rear region of the seat. A toggle arrangement is pivotally mounted on the chair support and engages the front end section of the at least one seat arm and front end section of the at least one backrest arm.

21 Claims, 7 Drawing Sheets

(58) Field of Classification Search
USPC ..... 297/300.1–300.8, 322
See application file for complete search history.

(56) References Cited

U.S. PATENT DOCUMENTS

| | | | | | |
|---|---|---|---|---|---|
| 4,494,795 | A * | 1/1985 | Roossien | A47C 1/03222 | 108/9 |
| 4,966,412 | A | 10/1990 | Dauphin | | |
| 4,988,145 | A * | 1/1991 | Engel | A47C 1/03255 | 297/300.4 X |
| 5,080,435 | A * | 1/1992 | Desanta | A47C 1/03255 | 297/316 |
| 5,308,144 | A | 5/1994 | Korn | | |
| 5,499,861 | A * | 3/1996 | Locher | A47C 1/03255 | 297/301.2 |
| 5,660,439 | A * | 8/1997 | Unwalla | A47C 1/03255 | 297/300.2 |
| 6,709,057 | B2 | 3/2004 | Sander et al. | | |
| 6,896,329 | B2 * | 5/2005 | Sander | A47C 1/03294 | 297/300.1 |
| 6,945,605 | B2 * | 9/2005 | Kinoshita | A47C 1/023 | 297/317 |
| 7,992,937 | B2 * | 8/2011 | Plikat | A47C 1/03255 | 297/300.2 |
| 8,215,710 | B2 * | 7/2012 | Erker | A47C 1/03255 | 297/300.2 |
| 8,544,955 | B2 * | 10/2013 | Kim | A47C 1/03255 | 297/285 |
| 2002/0180252 | A1 * | 12/2002 | Kinoshita | A47C 1/03238 | 297/300.4 X |
| 2006/0082201 | A1 * | 4/2006 | Link | A47C 1/03255 | 297/302.3 |
| 2009/0079238 | A1 * | 3/2009 | Plikat | A47C 1/03255 | 297/217.2 |
| 2009/0261637 | A1 * | 10/2009 | Schmitz | A47C 1/03255 | 297/217.2 |
| 2010/0289308 | A1 * | 11/2010 | Schmitz | A47C 1/03255 | 297/300.2 |

* cited by examiner

CHAIR WITH ADJUSTABLE BACKREST AND SEAT

BACKGROUND OF THE INVENTION

This invention relates to adjustable chairs and in particular such chairs having both an adjustable backrest and an adjustable seat.

Adjustable chairs are well known in the furniture industry including chairs wherein both the backrest position and the seat position can be adjusted or moved to make the chair more comfortable for the user. It is also known to provide chairs in which the seat and the backrest move synchronously by way of various synchronizing mechanisms. The synchronizing mechanism is able to change the position of the seat at the same time as the backrest is adjusted.

For example, U.S. Pat. No. 5,810,440 which issued on Sep. 22, 1998 to the present applicant describes a chair having a base, a seat, a backrest, a back support and a mechanism which interconnects the seat, back and back support and imparts a predetermined synchronous movement to the seat and back, e.g. rearward tilting of the seat and simultaneous rearward tilting of the back. The chair back has a rotation mechanism for rotatably connecting the chair back to the back support. The rotation is about a rotation axis which passes through the upper body of a person when the person is sitting on the seat and resting against the chair back. The bottom portion of the chair back is guided so that the bottom can move along an arc between a first position and a second position which is forward and lower than the first position.

More recent U.S. Pat. No. 6,709,057 to Armin Sander describes an adjustable chair having a backrest that is inclinable with regards to a seat carrier via a backrest carrier. The seat surface can be moved synchronously with the backrest and is supported on the seat carrier via at least one seat link. A coupling link linking the seat and the backrest carrier is provided for synchronization between the movement of the backrest and that of the seat surface.

Despite the adjustable chairs that are known in the seating industry, there is still a need for an improved chair that can be easily manufactured while at the same time being quite sturdy and durable. There is provided herein an adjustable chair wherein the pivoting movement of the backrest for the chair differs from the amount of pivoting of the seat. In a particular exemplary embodiment of the chair, the overall tilting mechanism for the backrest and the seat causes the rear end of the seat to move backwards and downwards with respect to the backrest when the seat and backrest are tilted backwardly and simultaneously the bottom edge of the backrest to move downwards and slightly rearwards with respect to the rear edge of the seat, thus reducing the horizontal and vertical gap between the rear end of the seat and the backrest.

SUMMARY OF THE INVENTION

According to one embodiment of the invention described herein, an adjustable chair comprises a chair base support, a backrest, a backrest support mechanism including at least one backrest arm pivotally connected to the base support and joined to the backrest, and a seat having front and rear regions and a top surface providing a seat surface defined by the front and rear regions. The or each backrest arm has a forward arm section and a rearward arm section extending in opposite directions from a respective backrest pivot point. The or each forward arm section has a first part of a first pivot mechanism located adjacent a front end of the backrest arm and spaced from the backrest pivot point. A first seat support mechanism adjustably connects the front region of the seat to the base support so that the seat can both pivot about a first horizontal axis extending in a transverse direction between the side edges and move in a front to rear direction and vice versa relative to the base support. A second seat support mechanism adjustably connects the rear region of the seat to the base support. This second seat support mechanism includes at least one seat arm having front and rear arm extensions and connected to the base support for pivotal movement about a second horizontal axis extending in the transverse direction and located between opposite front and rear ends of the seat arm. The rear arm extension is pivotally connected to the rear region of the seat at its respective rear end. The or each front arm extension has a first part of a second pivot mechanism for the respective seat arm adjacent the front end of the respective arm and spaced from the second horizontal axis. A toggle arrangement is mounted on the chair base support and operably engages both the front end section of the at least one seat arm and front end section of the at least one back rest arm. The toggle arrangement includes a second part of the first pivot mechanism that cooperates with the first part of the first pivot mechanism to form a complete backrest arm pivot mechanism, which includes a first pivot member spaced a distance D from the backrest pivot point and a second part of the second pivot mechanism that cooperates with the first part of the second pivot mechanism to form a complete seat arm pivot mechanism for the at least one seat arm. The second pivot mechanism includes a second pivot member spaced a distance "d" from the second horizontal axis. This toggle arrangement includes at least one additional pivot mechanism providing a third horizontal pivot axis. The distance d is different than the distance D so that the backrest and the at least one backrest arm pivot different degree amounts during use of the chair than the at least one seat arm.

An adjustable chair according to another embodiment of the invention includes a chair base support, a backrest, and a backrest support mechanism including a pair of backrest arms pivotally connected at a respective backrest pivot point to the base support and joined to the backrest. Each backrest arm has a forward arm section extending forwardly from its respective backrest pivot point and the rearward arm section extending rearwards from its respective backrest pivot point. Two toggle devices are each pivotally mounted on the chair base support and each operatively engages a respective one of the forward arm sections. There are also two first pivot mechanisms each pivotally connecting a respective one of the forward arm section to a respective one of the toggle devices. The chair includes a seat having a front, a rear, opposite side edges, and a top surface. A first seat support adjustably connects a front region of the seat to the base support so that the seat can both pivot about a horizontal axis extending in a transverse direction of the seat and move in a front to rear direction and vice versa relative to the base support. Also second seat supports adjustably connect a rear region of the seat to the base support. The second seat support includes two seat arms each having front and rear arm extensions and connected to the base support for pivotal movement about a second horizontal axis extending in the transverse direction and located between opposite front and rear ends of the seat arm. The rear arm extensions are pivotally connected to the rear region of the seat at the respective rear ends. The front arm extensions each have a first part of a second pivot mechanism for the respective seat arm adjacent the front end of the respective arm and spaced from the second horizontal axis. Each toggle device operatively engages the front arm extension of a respective one of the seat arms and includes the second part of the second pivot mechanism that cooperates with the first part of the second pivot mechanism to form a complete arm pivot mechanism for the respective seat arm. This complete mechanism includes a second pivot member spaced a distance d from the second horizontal axis. Each first pivot mechanism includes a first part located on its respective forward arm section and spaced from the respective backrest pivot point and a second part that cooperates with the first part to form a respective one of the first pivot mechanisms, which includes a first pivot member spaced a distance D from the respective backrest pivot point. The distance d is different from the distance D so that the backrest and its backrest arms pivot different degree amounts during use of the chair than the two seat arms.

In an exemplary embodiment, each toggle device is formed with two spaced-apart branches each formed with a respective elongate slot with one of the slots being the second part of the respective first pivot mechanism and the other slot being the second part of the respective second pivot mechanism.

According to yet another embodiment of the invention, an adjustable chair comprises a chair base support, a backrest, and an arm device for supporting the backrest. The arm device includes at least one backrest arm pivotally connected at a backrest pivot point to the base support and joined to the backrest. The or each backrest arm has a forward arm section extending in a forward direction of the chair and a rearward arm section extending in a rearward direction from its respective backrest pivot point. The or each forward arm section has a first pivot member mounted thereon and spaced a distance D from its backrest pivot point. There is also a seat having a front, a front region, a rear, a rear region, opposite side edges and a top surface providing a seating surface defined by the front and rear regions. A first seat support mechanism adjustably connects the front region of the seat to the base support so that the seat can both pivot about a first horizontal axis extending in a traverse direction between the side edges and move in a front to rear direction and vice versa relative to the base support. The chair also includes at least one seat arm adjustably connecting the rear region of the seat to the base support, the or each seat arm having a front arm extension extending in a forward direction and a rear arm extension extending in a rearward direction both from its respective seat pivot point. The seat arm can pivot about a second horizontal axis extending in a transverse direction relative to the seat. The or each rear arm extension is pivotally connected to the rear region of the seat. The or each front arm extension has a second pivot member spaced from the second horizontal axis by a distance d. At least one toggle device is pivotally mounted on the chair base support. The or each device is formed with an elongate slots arrangement for pivotally engaging the first and second pivot members. The distance d is different than the distance D so that the backrest and the at least one backrest arm pivot different degree amounts during use of the chair than the at least one seat arm.

The invention is illustrated and described herein as embodied in an office chair. The invention is not intended to be limited to the details shown, since various modifications and structural changes may be made to the chair without departing from the scope of the invention. Further features, advantages and aspects of the chair will be best understood from the following detailed description of specific embodiments in connection with the accompanying drawings.

DESCRIPTION OF EXEMPLARY EMBODIMENTS

Figure 1:
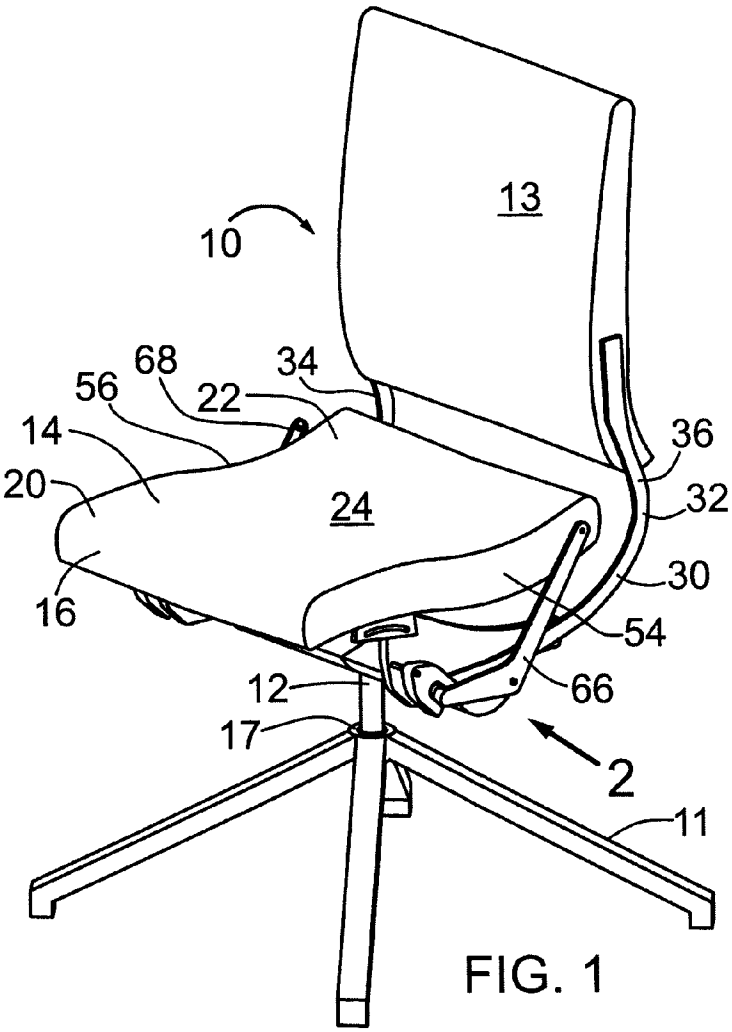
FIG. 1 is a perspective view of an office chair constructed in accordance with the invention and shown in an upright position, this view being taken from above and from the front of the chair.
Figure 4:
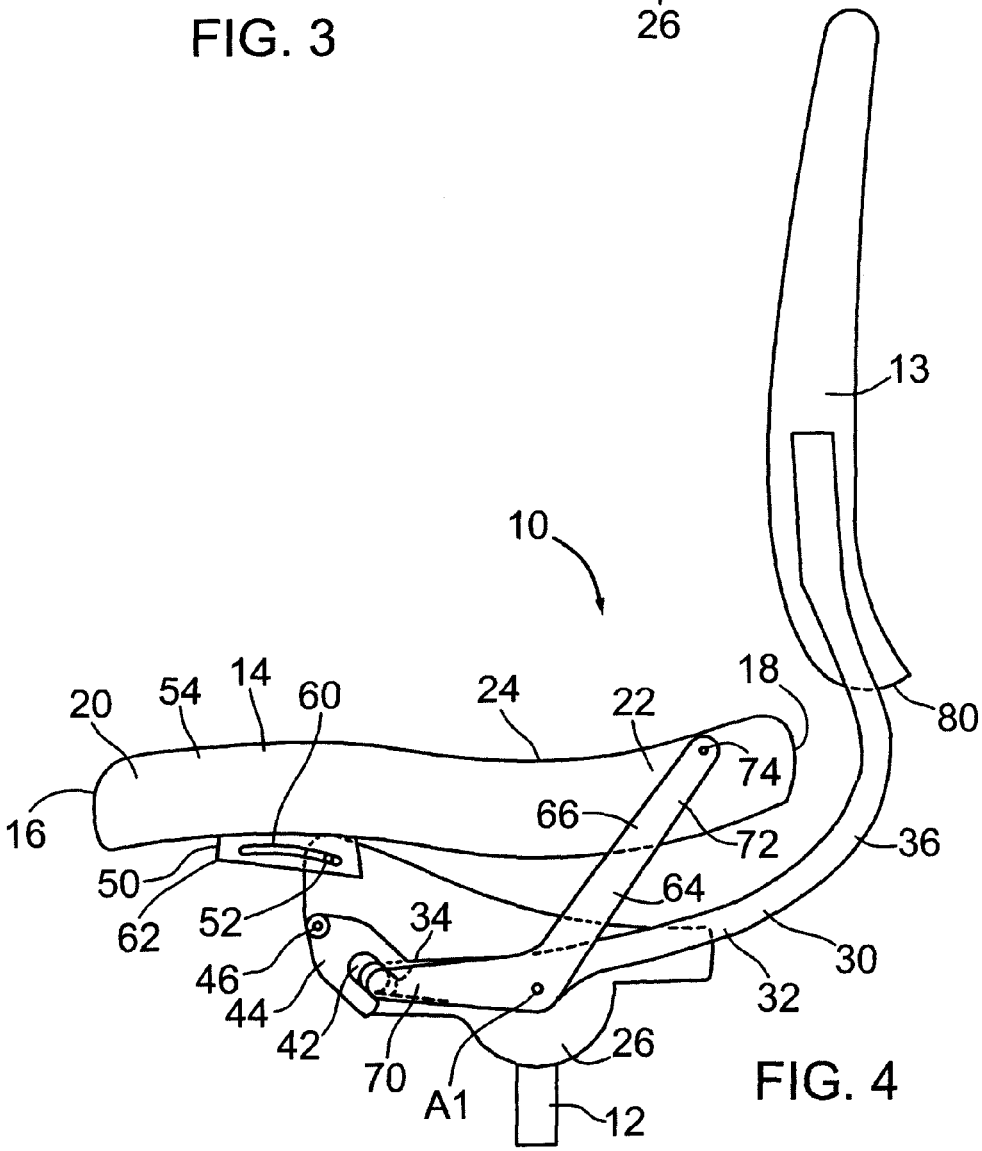
FIG. 4 is a schematic side view of the office chair shown in an upright position, the bottom base of the chair being omitted for ease of illustration.

FIGS. 1 and 4 illustrate an office chair 10 having a standard base 11 which has been omitted from FIG. 4 for ease of illustration. This standard base can, for example, include a central support cylinder 17 with a vertical axis which receives the illustrated post 12. Four or five spokes or legs can extend radially outwardly from this cylinder or sleeve and are rigidly connected thereto. The spokes or legs can be supported on well known casters (not shown) so that the chair can be readily moved on a floor surface. The illustrated upper portion of the chair includes a backrest 13 and a seat 14 having a front 16 and a rear 18. By way of further explanation, the seat also has a front region 20 and a rear region 22 which together form the overall seat. The seat has a top surface 24 that provides a seating surface for a person and that is defined by the front and rear regions. The top surface 24 can be contoured as desired to make it comfortable for the user.

Located below the seat is a chair base support indicated generally by reference 26 and this base support can be rigidly connected to the top of the post 12. Alternatively there can be more than one post or leg supporting the base support. If desired, the base support and the attached operating mechanism to be described can be enclosed in a suitably attractive enclosure or housing (not shown).

Figure 2:
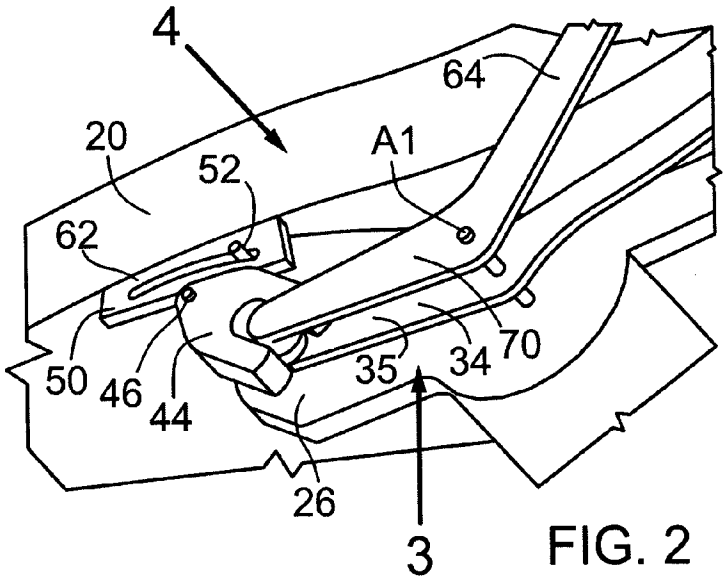
FIG. 2 is a detail view in perspective showing the seat support mechanism for a front region of the chair seat and front portions of both seat and backrest support arms, this view being taken in the direction of arrow 2 in FIG. 1.

The backrest 13 is mounted on a backrest support mechanism indicated generally at 30 which can include a pair of backrest arms 32, 34 pivotally connected to the base support at A1. Each backrest arm has a forward arm section 35, which is clearly shown in FIGS. 2 and 3, and a rearward arm section 36, these two arm sections extending in opposite directions from the respective backrest pivot point located at A1. Each forward arm section 35 has a first pivot member located adjacent a front end of the respective backrest arm and spaced a distance D from the respective backrest pivot point A1. An exemplary form of the first pivot member comprises a roller 40 rotatably mounted on a support pin extending from the front section of the backrest arm. Each roller moves in a slot 42 formed in one of two toggle members 44. The two toggle members form a toggle arrangement that is pivotally mounted on the chair base support 26. The toggle member 44 shown in FIG. 2 is able to pivot about a pivot pin 46 located at the forward end of the toggle member.

The chair 10 also includes a first seat support mechanism 50 that adjustably connects the front region 20 of the seat to the base support 26 in a manner that permits the seat to pivot about a first horizontal axis provided by a further pivot pin 52, this axis extending in a transverse direction between side edges 54 and 56 of the seat. The pivot pin 52 is mounted in the base support 26. Furthermore this first seat support mechanism 50 also allows the seat to pivot about the pin 52 and to move in a front to rear direction and vice versa relative to the base support 26 (as seen from a comparison of FIGS. 4 and 5). In the embodiment of FIGS. 1 to 4 a slightly curved slot 60 is slidable along the pivot pin 52. The slot 60 is formed in a downwardly extending connecting plate 62 rigidly attached to the bottom of the seat 14. In an exemplary version of the chair, the two slotted plates 62 are mounted adjacent opposite side edges of the seat but it is also possible to mount them closer to the transverse center of the seat on opposite sides of this center.

Figure 7:
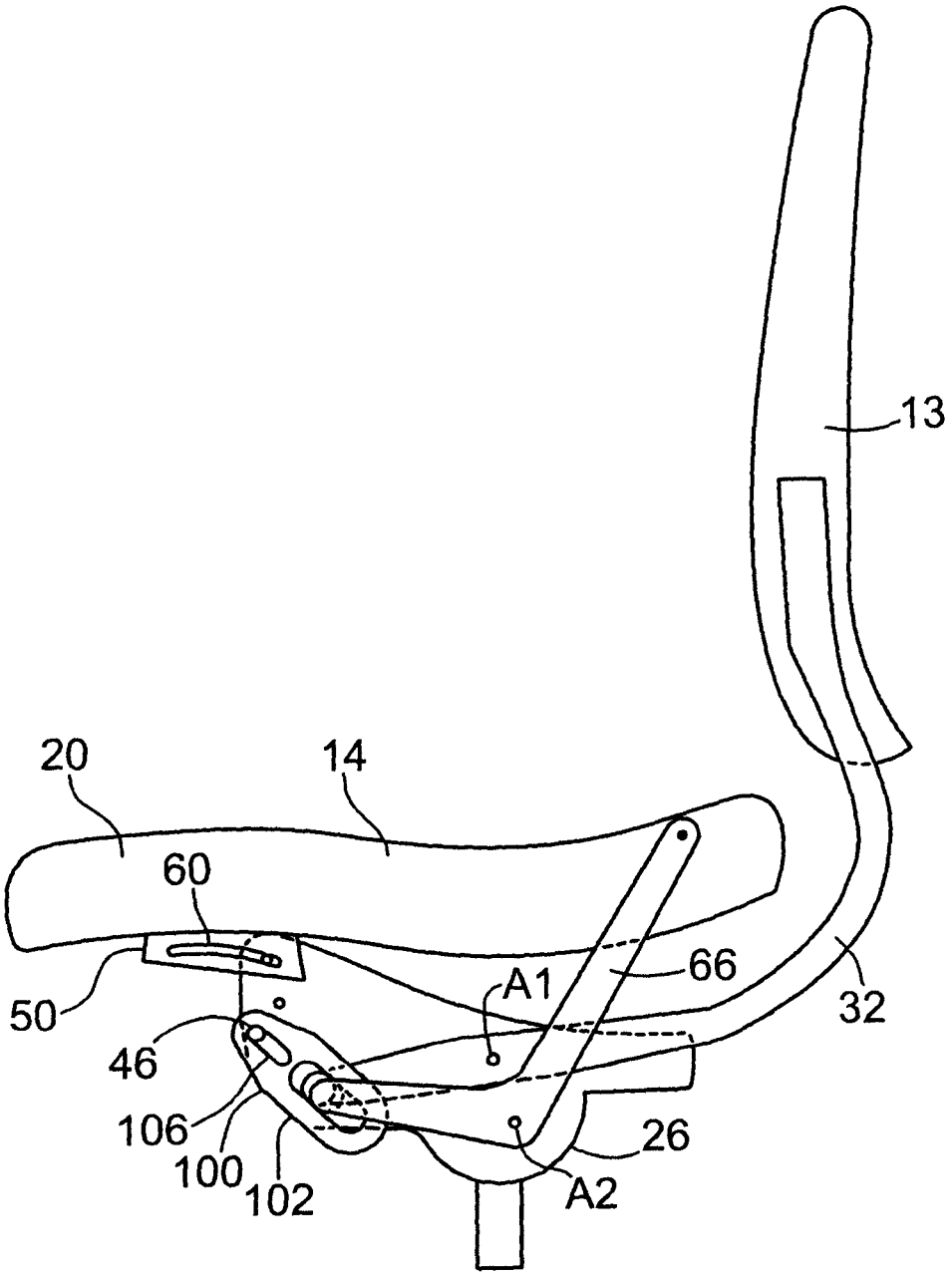
FIG. 7 is a schematic side view of an alternate chair construction, the chair being shown in an upright position.

The seat 14 is also supported by a second seat support mechanism 64 which adjustably connects the rear region 22 of the seat to the base support 26. The second seat support mechanism includes two seat arms 66, 68 each having a front arm extension 70 and a rear arm extension 72 and connected to the base support 26 for pivotal movement about a second horizontal axis which can be located at A1 or a suitable pivot axis A2 offset from the axis A1. This second horizontal axis also extends in the transverse direction like the first axis and it is located between opposite front and rear ends of each seat arm. The chair illustrated in FIG. 7 is constructed so that the pivot axis A2 is spaced below and slightly rearwards of the axis A1. The rear arm extensions are pivotally connected to the rear region of the seat at their respective rear ends such as by means of a pivot pin 74 mounted in the frame of the seat. Each front arm extension has an arm pivot member adjacent the front end of the respective arm and spaced a distance d from the second horizontal axis (see FIG. 3). Again, in an exemplary embodiment, this arm pivot member comprises a roller 75, such as a hard plastic roller, mounted on a pivot pin. Plastic rollers are preferred on both the backrest arms and the seat arms to allow for quiet operation of the tilting mechanism. It is also possible to construct these rollers from metal. Alternatively, it is possible to omit the use of a roller entirely on each seat arm and each backrest arm and to use a metal pivot pin or similar member to engage the respective toggle member 44.

Figure 8:
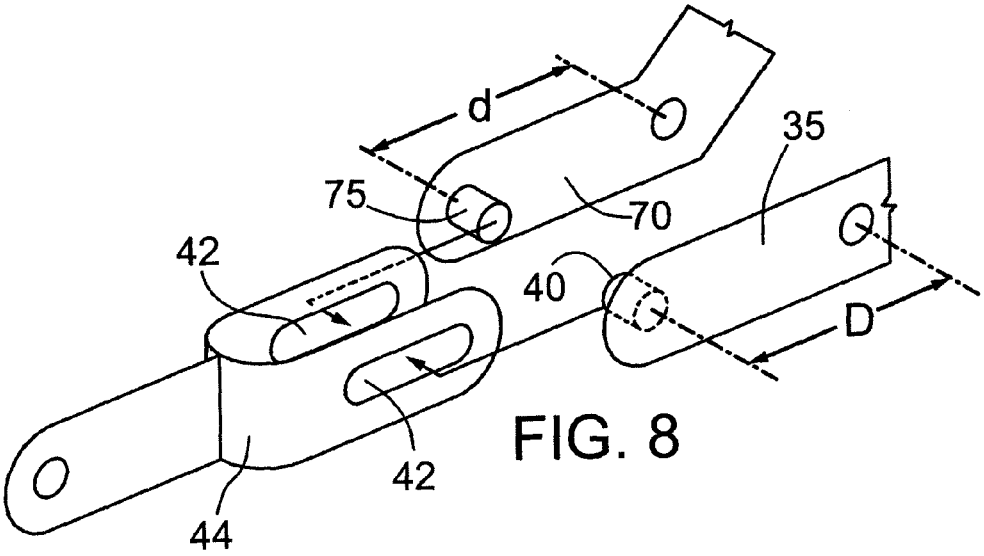
FIG. 8 is an exploded schematic detail view showing the toggle arrangement used in the chair of FIGS. 1 to 4.

Either a single wide slot or two adjacent slots 42 can be formed in each toggle member to receive the respective rollers mounted at the front ends of the backrest arm and the seat arm. FIG. 8 illustrates schematically the use of two slots 42 in the toggle member. The slot or slots have a width which closely corresponds to that of the roller or rollers that are movable in the slot. The present chair 10 can be biased towards the upright position shown in FIGS. 1, 4, 6 and 7 by any of several different forms of known biasing mechanisms. The biasing mechanism can for example include a metal or elastomeric torsion spring mounted around the pivot pin at A1 or A2 and having one end engaging either the adjacent backrest arm 32 or the adjacent seat arm and the other end engaged in the chair base support 26 through known tensioning mechanism. A compression metal or elastomeric band can also be used as a biasing mechanism, if desired.

Operation of the Exemplary Chair

Figure 5:
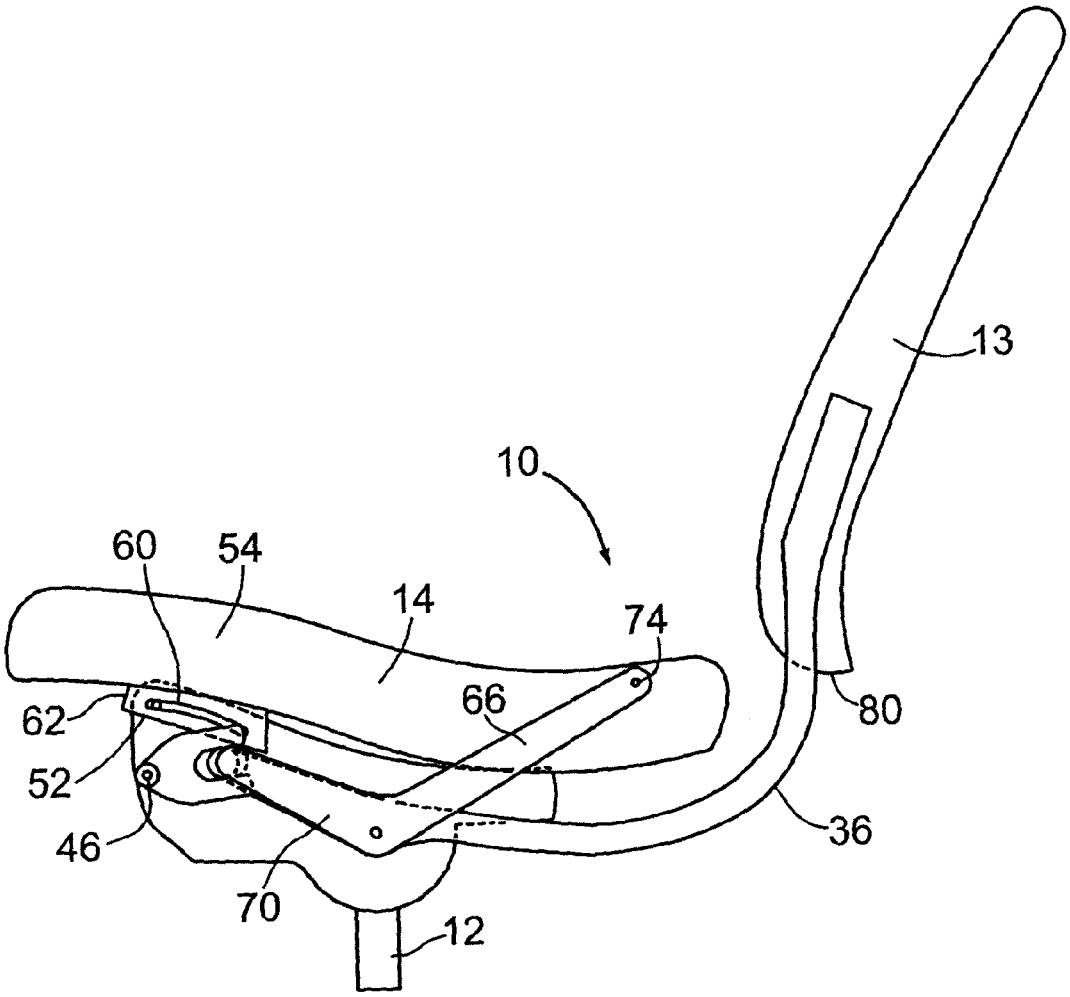
FIG. 5 is another schematic side view of the office chair of FIG. 4, this view showing a second, inclined position for the backrest and seat.

From the above description of the chair 10, it will be readily seen that when a user is sitting in the upright position shown in FIG. 4, he is able to tilt the chair backwards to the position shown in FIG. 5 by pressing against the backrest 13 and overcoming the biasing force of the biasing mechanism. At the same time as the backrest is tilted rearwardly the seat 14 pivots downwards at its back edge 18 or, in other words, in the clockwise direction as the chair is shown in FIGS. 1 and 4. This tilting motion causes the front arm extension 70 of the seat arm to rotate or pivot upwards (that is in the clockwise direction as the chair is illustrated in FIGS. 4 and 5). This pivotal movement of the two seat arms causes the two toggle members 44 to pivot upwardly from the position shown in FIG. 4 to that shown in FIG. 5, that is, in a counterclockwise direction around the pivot pin 46. This pivotal movement of the two toggle members moves the forward arm sections 34 of the two backrest arms upwards (in the clockwise direction about the pivot axis for the arms 32). Thus in a synchronous manner, the pivoting and moving of the seat 14 causes a backward tilting of the backrest 13. While this is occurring the slot 60 moves rearwards relative to the pin 52. In this way, the seat moves rearwards and slightly downwards at its front end and rearwards and downwards at its rear end.

In a particular exemplary embodiment of the chair 10, the lengths of the front arm sections 70 and forward arms section 35 are different, which results in a variation in the pivotal movement between the seat 14 and the backrest 13. In the exemplary embodiment, for approximately every 10 degrees of rotation of the two seat arms 66, 68 the backrest arms 32, 34 pivot approximately 9 degrees. It will be understood that the length of the front arm extension 70 and the forward arm sections 35 can be set or adjusted to obtain the desired difference in the pivotal movement of the seat and the backrest. In the exemplary embodiment where the front end of the seat is sliding effectively backwards and very slightly downwards, the resulting motion is that the angle of tilt of the backrest changes at a faster rate than the seat angle. It will be understood that for each tilt angle of the backrest 13 there is a corresponding, specific seat angle.

To explain the chair movement further, as the chair is tilted backwards, the rear end 18 of the seat moves downwards and backwards and the bottom end of the backrest moves downwards and also backwards. The result is that as the chair is tilted backwards, the rear edge of the seat moves backwards at a faster rate than the bottom edge of the backrest. Also, the bottom edge of the backrest moves downwards at a faster rate than the rear edge of the seat. The net effect is that when the chair is tilted, it reduces the horizontal and vertical gap between the rear end of the seat and the backrest.

Thus the present chair tilting mechanism is set up to provide a differential movement between the pivoting motion of the seat and the pivoting motion of the backrest. The reverse is also true when the chair is allowed to move from the tilted position to the upright position. Although the illustrated exemplary embodiment is constructed so that the front end arm sections 70 are shorter than the forward arm sections 35 of the backrest support mechanism, the reverse arrangement is also possible so that the front arm extensions 70 are longer than the forward arm sections 35 and the latter arrangement will also give differential synchronous movement between the seat and the backrest.

Figure 3:
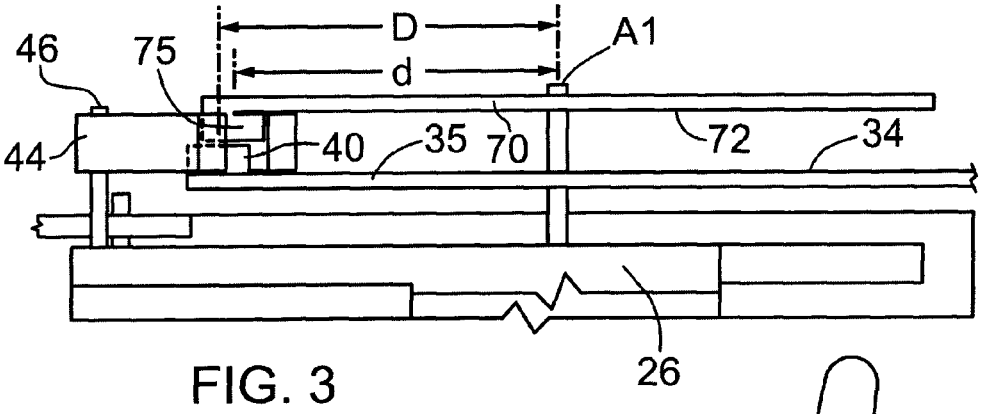
FIG. 3 is another detail view taken from below as indicated by the arrow 3 in FIG. 2, this view showing the front portions of the seat and backrest arms.

Although the pivot pins for the seat arms 66, 68 and for the backrest arms 32 are shown at the same A1 location in FIGS. 2 to 4, this is not essential for the present mechanism and in fact the pivot pins for the seat arms can be displaced and not in alignment with the pivot pins for the backrest arms 32. If desired, the pivot pins for the seat arms can be located above, below, forward, or aft of the horizontal axis for the backrest arms 32.

Figure 6:
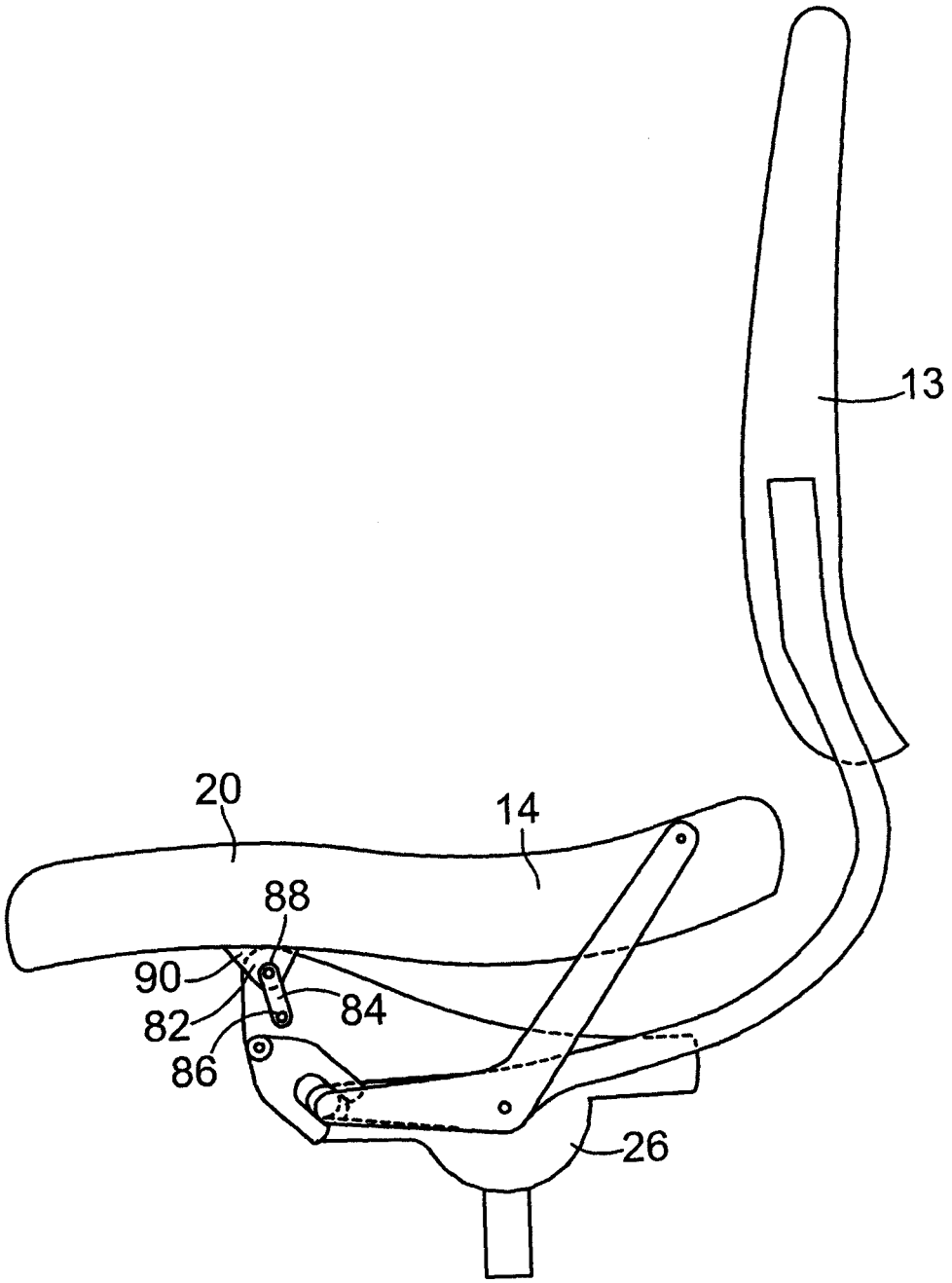
FIG. 6 is a schematic side view of an alternate version of the chair in the upright position.

An alternate construction for the first seat support mechanism is illustrated in FIG. 6. This first seat support mechanism is indicated at 82. The mechanism 82 again adjustably connects the front region 20 of the seat to the base support 26 so that the seat 14 can both pivot about a first horizontal axis extending in the transverse direction and also move in a front to rear direction and vice versa relative to the base support. The seat support mechanism 82 includes two relatively short links 84 which are spaced apart and operate in a similar manner. The links are pivotally connected at both ends with their bottom ends connected by pivot pins 86 to the base support. The top ends of the links are connected by pivot pins 88 to a bracket or angle member 90 attached to the front region of the seat.

Figure 9:
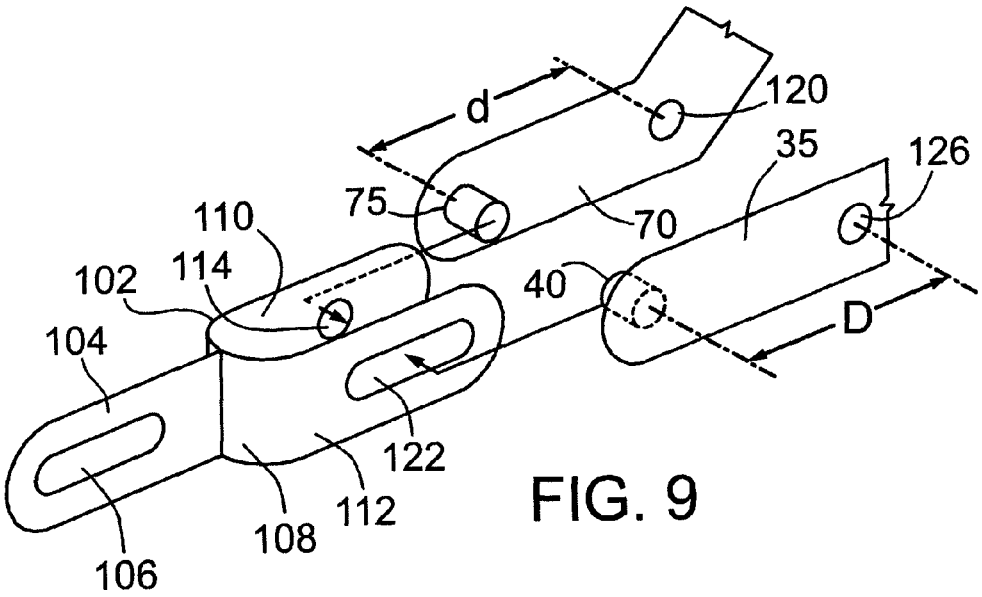
FIG. 9 is an exploded schematic detail view of another form of toggle arrangement for the seat and backrest support arms.

The chair illustrated in FIG. 7 employs a different form of toggle arrangement indicated generally at 100, this arrangement again being mounted on the chair base support and operatively engaging both front end sections of the two seat arms 66, 68 and front end sections of the backrest arms 32, 34. The toggle arrangement 100 comprises two toggle members 102 which can be constructed in the manner illustrated schematically in FIG. 9. The toggle member 102 has a single forward section 104 with an elongate slot 106 formed therein. The forward section is rigidly connected to a U-shaped rearward section 108 having two spaced-apart branches 110 and 112. A round hole 114 is centrally located in the branch 110 and is sized to receive and pivotally support the pivot pin 75 provided on the forward end of front arm extension 70. The pivot pin 75 is located a distance d from the seat arm pivot axis located at 120. It will be understood that the pivot axis at 120 can correspond to the aforementioned pivot axis A1 or A2. Formed in the branch 112 is an elongate slot 122 extending in the longitudinal direction of the branch. The roller 40 at the front end of the forward arm extension 35 is arranged in the slot 122 and the slot is able to move relative to the roller. The axis of the roller 40 is located the distance D from the horizontal pivot axis located at 126 which may or may not be aligned with the pivot axis at 120. The pivot pin 46 which is mounted on the base support 26 extends into the slot 106. It will thus be appreciated that each toggle member 102 is able to pivot about the axis at pivot pin 46 and is also able to move in the longitudinal direction along the pivot pin. The toggle arrangement 100 can synchronize the tilting movement of the backrest support with the movement of the chair seat in a manner similar to the toggle arrangement of FIG. 8. Again, by making the distance d different from the distance D, the backrest and its backrest arms will pivot a different amount during use of the chair than the two seat arms.

Figure 10:
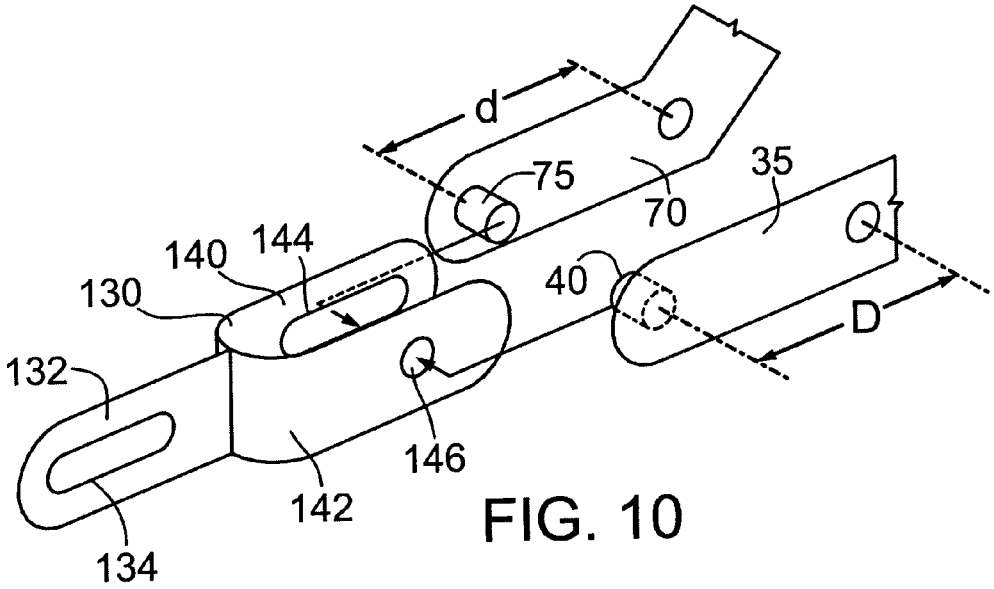
FIG. 10 is another exploded detail view similar to FIG. 9 but showing a further toggle arrangement for the seat and backrest support arms.

A similar but different toggle arrangement 130 is illustrated in FIG. 10 which shows schematically a toggle member 130. Like the toggle member 102 of FIG. 9, this toggle member has a forward section 132 with a slot 134 formed therein. This toggle member also has two branches 140 and 142 that are part of a U-shaped rearward section. In this embodiment, the elongate slot 144 is formed in the branch 140 while the circular hole 146 is formed in the branch 142. The pivot pin 40 or roller is provided on the forward end of each forward arm section 35 and is pivotally connected to the branch 142 by extending into the hole 146. The roller or pivot pin 75 is provided at the forward end of the front arm extension 70 and extends into the slot 144 for movement relative to the slot. It will be appreciated that the two toggle members 130, only one of which is shown in FIG. 10, together form a toggle arrangement which operates in an analogous manner as the toggle arrangement 100. Again, by making the distance d different than the distance D, the backrest and its backrest arms pivot a different amount during the use of the chair than the two seat arms providing a desirable synchronous action between the backrest and the seat.

Figure 11:
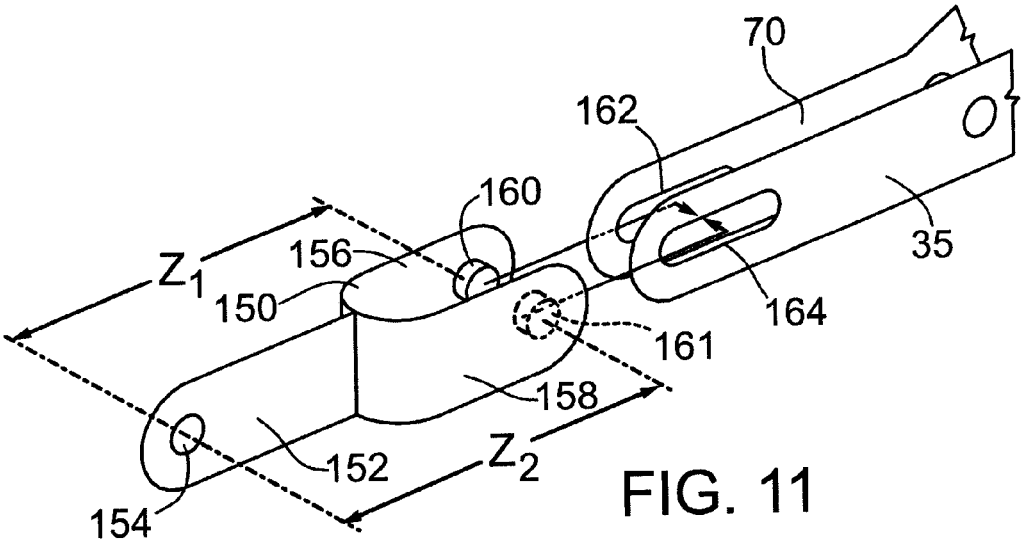
FIG. 11 is yet another exploded detail view showing another toggle arrangement for the support arms.

Another toggle arrangement is illustrated schematically by FIG. 11 which shows a toggle member 150. Again there are two of these toggle members provided on each chair, one on each of the opposite sides of the chair. This toggle member has a forward section 152 which can be provided with a circular hole 154 to accommodate a pivot pin (similar to the pivot pin 46 shown in FIGS. 2, 3, 4, 5 and 7). The rearward section of the toggle again has two branches 156, 158 and rotatably mounted on each of these branches is a suitable roller 160, 161. The two illustrated rollers are located on the inner surface of each branch but it is also possible to mount them on the outer surface of each branch. The roller 160 is mounted a distance $Z_1$ from the center of the hole 154 while the roller 161 is mounted a distance $Z_2$ from the center of the hole 154. By making the distances $Z_1$ and $Z_2$ different, the amount by which the backrest arms pivot will vary relative to the amount of tilting of the two seat arms. Thus the distances $Z_1$ and $Z_2$ have a similar effect on the pivoting motion of the backrest and the seat as the distances d and D of the other embodiments. In the front end section of the front arm extension 70 is an elongate slot 162 while formed in the front end section of the forward arm section 35 is another slot 164. The roller 160 on the branch 156 is mounted in the slot 162 while the other roller 161 is mounted in the slot 164 and these rollers can move back and forth in their respective slots and there can be relative pivotal movement between the slots and their rollers. This alternative toggle arrangement can also provide a desirable synchronous movement between the tilting of the backrest and the movement of the seat. Various combination of the toggles are also possible such that either a slot or pin is used in the front extension of the seat or back arm, to engage either a pin or slot respectively in the forked rear end of the toggle.

It will be appreciated that the present chair can come with optional or additional features that are well known in the chair art. For example the backrest 13 can be flexibly attached to the seat 14, such as by a flexible cloth or leather strip extending between the rear end 18 of the seat and the bottom edge 80 of the backrest. It is possible to provide a seat 14 with a seat depth adjustment capability using known adjustment mechanisms. It is also possible to provide back height adjustment if required in addition to lumbar adjustment by known adjustment mechanisms.

With respect to the biasing mechanism to return the chair to the upright position, it is well known to make these biasing mechanisms adjustable, for example by increasing or decreasing the tension in the mechanism. Various mechanisms are also known in the chair art for adjusting the height of the seat, for example by allowing adjustment of the height of the post 12 relative to the column or sleeve in which the post fits.

While the present invention has been illustrated and described as embodied in several different exemplary embodiments, that is embodiments having particularly utility as chairs, it is to be understood that the present invention is not limited to the details shown here, since it will understand that various omissions, modifications, and changes in the forms and details of the disclosed chair and its operation may be made by those skilled in the art without departing in any way from the scope of the present invention.

What is claimed is:

1. An adjustable chair comprising:

a chair base support;

a backrest;

a backrest support mechanism including at least one backrest arm pivotally connected to said base support and joined to the backrest, the at least one backrest arm having a forward arm section extending in a forward direction and a rearward arm section extending in a rearward direction from a backrest pivot point, the forward arm section having a first part of a first pivot mechanism located adjacent a front end of the backrest arm and spaced from the backrest pivot point;

a seat having a front, a front region, a rear, a rear region, opposite side edges, and a top surface providing a seating surface defined by said front and rear regions;

a first seat support mechanism adjustably connecting said front region of the seat to said base support so that said seat can both pivot about a first horizontal axis extending in a transverse direction between said side edges and move in a front to rear direction and vice versa relative to said base support;

a second seat support mechanism adjustably connecting said rear region of the seat to said base support, said second seat support mechanism including at least one seat arm having front and rear arm extensions and connected to said base support for pivotal movement about a second horizontal axis extending in said transverse direction and located between opposite front and rear ends of the seat arm, the rear arm extension being pivotally connected to said rear region of the seat at the rear end, the front arm extension having a first part of a second pivot mechanism for the seat arm adjacent the front end of the seat arm and spaced from the second horizontal axis; and a toggle arrangement mounted on said chair base support and operatively engaging the front arm extension of the at least one seat arm and the front end section of the at least one backrest arm, said toggle arrangement including both a second part of the first pivot mechanism that cooperates with said first part of the first pivot mechanism to form a complete backrest arm pivot mechanism, which includes a first pivot member spaced a distance (D) from the backrest pivot point, and a second part of the second pivot mechanism that cooperates with the first part of the second pivot mechanism to form a complete arm pivot mechanism for the at least one seat arm, which includes a second pivot member spaced a distance (d) from said second horizontal axis, said toggle arrangement including at least one additional pivot mechanism spaced from the first and second pivot mechanisms and providing a third horizontal pivot axis, wherein said distance (d) is different than the distance (D) so that the backrest and the at least one backrest arm pivot different degree amounts during the use of the chair than the at least one seat arm.

2. The adjustable chair according to claim 1, wherein the backrest and the at least one backrest arm pivot to a greater extent during adjustment of said backrest than the at least one seat arm.

3. The adjustable chair according to claim 1, wherein said rearward arm section of the at least one backrest arm is substantially longer than the forward arm section.

4. The adjustable chair according to claim 3, wherein said rearward arm section of the at least one backrest arm is bent along a length of said rearward arm section so that a rear portion thereof extends upwardly and is attached to said backrest.

5. The adjustable chair according to claim 1, wherein said first seat support mechanism includes at least one slotted connecting plate fixedly mounted on said seat and at least one pivot pin, the at least one pivot pin extending into the slotted connecting plate or a respective one of said slotted connecting plates and mounted on said chair base support whereby the at least one slotted connecting plate is adapted to slide along respective pivot pin.

6. The adjustable chair according to claim 1, wherein said first seat support mechanism includes at least one pivotal link, the at least one pivotal link having a first link end pivotally connected to the seat and a second link end pivotally connected to the chair base support.

7. The adjustable chair according to claim 1, wherein said toggle arrangement includes two toggle members which are spaced apart from one another in a transverse direction in relation to said seat and wherein said at least one additional pivot mechanism comprises two of the additional pivot mechanisms, each additional pivot mechanism pivotally connecting a respective one of said toggle members to said chair base support.

8. The adjustable chair according to claim 7, wherein each toggle member is formed with two spaced-apart branches, each spaced-apart branch formed with a respective elongate slot, one of the two elongate slots being the second part of the first pivot mechanism and the other of the two slots being the second part of the second pivot mechanism.

9. The adjustable chair according to claim 7, wherein each toggle member is formed with two spaced-apart branches one of which is formed with an elongate slot and the other of which is formed with a round pivot hole, said elongate slot being the second part of the first pivot mechanism and the round pivot hole being the second part of the second pivot mechanism.

10. The adjustable chair according to claim 7, wherein each toggle member is formed with two spaced-apart branches, each spaced-apart branch having a roller rotatably mounted thereon, one of the two rollers being the second part of the first pivot mechanism and the other of the two rollers being the second part of the second pivot mechanism.

11. An adjustable chair comprising:

a chair base support;

a backrest;

a backrest support mechanism including a pair of backrest arms pivotally connected at a respective backrest pivot point to said base support and joined to the backrest, each backrest arm having a forward arm section extending forwardly from respective backrest pivot point and a rearward arm section extending rearwards from respective backrest pivot point;

two toggle devices, each toggle device pivotally mounted on said chair base support and operatively engaging a respective one of the forward arm sections;

two first pivot mechanisms, each first pivot mechanism pivotally connecting a respective one of the forward arm sections to a respective one of the toggle devices;

a seat having a front, a rear, opposite side edges and a top surface;

first seat support means adjustably connecting a front region of the seat to said base support so that said seat can both pivot about a horizontal axis extending in a transverse direction of the seat and move in a front to rear direction and vice versa relative to said base support; and second seat support means adjustably connecting a rear region of the seat to said base support, said second seat support mechanism including two seat arms, each seat arm having front and rear arm extensions and connected to said base support for pivotal movement about a second horizontal axis extending in said transverse direction and located between opposite front and rear ends of each seat arm, said rear arm extensions being pivotally connected to a rear region of the seat at their respective rear ends, each of said front arm extensions having a first part of a second pivot mechanism for the seat arm adjacent the front end of the seat arm and spaced from the second horizontal axis; and wherein each toggle device operatively engages the front arm extension of a respective one of the seat arms and includes the second part of the second pivot mechanism that cooperates with the first part of the second pivot mechanism to form a complete arm pivot mechanism for the respective seat arm, which includes a second pivot member spaced a distance (d) from the second horizontal axis; and wherein each first pivot mechanism includes a first part located on the respective forward arm section and spaced from the respective backrest pivot point and a second part that cooperates with said first part to form a respective one of the first pivot mechanisms, which includes a first pivot member spaced a distance (D) from the respective backrest pivot point, and;

wherein said distance (d) is different than the distance (D) so that the backrest and the backrest arms pivot different degree amounts during use of the chair than the two seat arms.

12. The adjustable chair according to claim 11, wherein each toggle device is formed with two spaced-apart branches, each spaced-apart branch formed with a respective elongate slot, one of the two elongate slots being the second part of the respective first pivot mechanism and the other of the two elongate slots being the second part of the respective second pivot mechanism.

13. The adjustable chair according to claim 11, wherein each toggle device is formed with two spaced-apart branches one of which is formed with an elongate slot and the other of which is formed with a round pivot hole, said elongate slot being the second part of respective first pivot mechanism and the round pivot hole being the second part of the second pivot mechanism.

14. The adjustable chair according to claim 11, wherein each toggle device is formed with two spaced-apart branches, each spaced-apart branch having a roller rotatably mounted thereon, one of the two rollers being the second part of respective first pivot mechanism and the other of the two rollers being the second part of respective second pivot mechanism.

15. The adjustable chair according to claim 11, wherein said first support means includes two slotted plates fixedly mounted on said seat and spaced apart in the transverse direction of the seat and two pivot members, each pivot member extending into a respective one of said slotted connecting plates and mounted on said chair base support whereby each slotted connecting plate is adapted to slide along a respective one of said pivot members.

16. An adjustable chair comprising:

a chair base support;

a backrest;

arm means for supporting said backrest, said arm means including at least one backrest arm pivotally connected at a backrest pivot point to said base support and joined to the backrest, the at least one backrest arm having a forward arm section extending in a forward direction of the chair and a rearward arm section extending in a rearward direction from the backrest pivot point, the forward arm section having a first pivot member mounted thereon and spaced a distance (D) from the backrest pivot point;

a seat having a front, a front region, a rear, a rear region, opposite side edges, and a top surface providing a seating surface defined by said front and rear regions;

a first seat support mechanism adjustably connecting said front region of the seat to said base support so that said seat can both pivot about a first horizontal axis extending in a transverse direction between said side edges and move in a front to rear direction and vice versa relative to said base support;

at least one seat arm adjustably connecting said rear region of the seat to said base support, the at least one seat arm having a front arm extension extending in a forward direction and a rear arm extension extending in a rearward direction both from respective seat pivot point where the seat arm can pivot about a second horizontal axis extending in a transverse direction relative to the seat, the rear arm extension being pivotally connected to said rear region of the seat, the front arm extension having a second pivot member spaced from the second horizontal axis by a distance d; and at least one toggle device, the at least one toggle device pivotally mounted on said chair base support and formed with elongate slot means for pivotally engaging said first and second pivot members, wherein said distance (d) is different than distance (D) so that the backrest and the at least one backrest arm pivot different degree amounts during use of the chair than the at least one seat arm.

17. The adjustable chair according to claim 16, wherein the at least one toggle device is formed with two spaced-apart branches and the slot means for the at least one toggle device comprises two elongate slots, each elongate slot being formed in a respective one of the branches and receiving a respective one of the first and second pivot members.

18. The adjustable chair according to claim 16, wherein the rearward arm section of the at least one backrest arm is substantially longer than the corresponding forward arm section and is bent along a length of the rearward arm section so that a rear portion thereof extends upwardly and is attached to said backrest.

19. The adjustable chair according to claim 16, wherein said first seat support mechanism includes at least one slotted connecting plate fixedly mounted on said seat and at least one pivot pin extending into said at least one slotted connecting plates and mounted on said chair base support whereby the at least one slotted connecting plate is adapted to slide along the at least one pivot pin.

20. The adjustable chair according to claim 16, wherein said first seat support mechanism includes at least one pivotal link, the at least one pivotal link having a first link end pivotally connected to the seat and a second link end pivotally connected to the chair base support.

21. The adjustable chair according to claim 16, wherein both said first and second pivot members include rollers rotatably mounted on support pins, the diameter of each roller being approximately equal to a width of the respective elongate slot in which the roller is mounted.

* * * * *